US009033442B2

(12) United States Patent
Kanno et al.

(10) Patent No.: US 9,033,442 B2
(45) Date of Patent: May 19, 2015

(54) PRINTING APPARATUS AND DISCHARGE INSPECTION METHOD

(75) Inventors: Hideo Kanno, Yokohama (JP); Nobuyuki Hirayama, Fujisawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 259 days.

(21) Appl. No.: 13/462,936

(22) Filed: May 3, 2012

(65) Prior Publication Data

US 2012/0306953 A1 Dec. 6, 2012

(30) Foreign Application Priority Data

Jun. 6, 2011 (JP) ..... 2011-126700

(51) Int. Cl.
*B41J 29/38* (2006.01)
*B41J 2/045* (2006.01)

(52) U.S. Cl.
CPC ..... *B41J 2/0458* (2013.01); *B41J 2/0451* (2013.01); *B41J 2/04563* (2013.01); *B41J 2/04596* (2013.01)

(58) Field of Classification Search
CPC ..... B41J 2/04588; B41J 2/04581; B41J 2/04596; B41J 2/04541; B41J 2/04593
USPC ..... 347/11, 10
See application file for complete search history.

(56) References Cited

U.S. PATENT DOCUMENTS 6,296,341 B1 10/2001 Sugahara
7,673,961 B2 3/2010 Shihoh et al.
7,722,148 B2 5/2010 Takabayashi et al.
7,950,765 B2 5/2011 Takabayashi et al.
2003/0063143 A1* 4/2003 Coven et al. ..... 347/11
2007/0291067 A1 12/2007 Aoki et al.
2007/0291069 A1* 12/2007 Shihoh et al. ..... 347/19
2010/0118069 A1* 5/2010 Kayahara et al. ..... 347/9
2011/0164085 A1 7/2011 Takabayashi et al.

FOREIGN PATENT DOCUMENTS

JP H11-300965 A 11/1999
JP 2007-290361 A 11/2007
JP 2007-331193 A 12/2007
JP 2008-000914 A 1/2008

OTHER PUBLICATIONS

Feb. 23, 2015 Japanese Office Action in Japanese Patent Application No. 2011-126700.

* cited by examiner

*Primary Examiner* — Manish S Shah
*Assistant Examiner* — Yaovi Ameh
(74) *Attorney, Agent, or Firm* — Fitzpatrick, Cella, Harper & Scinto

(57) ABSTRACT

A printing apparatus includes a control unit configured to perform control so as to apply a first driving voltage to a heat generation element to discharge ink from an orifice and then apply a second driving voltage to the heat generation element so as not to cause bubbling or discharging of ink. In this case, the control unit performs control to apply the second driving voltage before detection of a feature point on the waveform of a signal representing temperatures in a temperature drop process detected by the temperature detection element after application of the first driving voltage and along with the application of the first driving voltage based on a temperature detected by a temperature detection element.

6 Claims, 11 Drawing Sheets

PRINTING APPARATUS AND DISCHARGE INSPECTION METHOD

BACKGROUND OF THE INVENTION

1. Field of the Invention

The present invention relates to a printing apparatus and a discharge inspection method.

2. Description of the Related Art

In an ink-jet printing head, discharge failure sometimes occurs in all or some nozzles due to clogging of nozzles with foreign substances, bubbles entering ink supply channels, changes in the wettability of nozzle surfaces, or the like. It is an important challenge for such a printhead to specify a nozzle subjected to discharge failure and reflect the failure in image supplement or recovery operation for the printhead.

In consideration of this challenge, Japanese Patent Laid-Open No. 2007-290361 has proposed a method of inspecting a nozzle subjected to discharge failure from the manner of changes in temperature obtained by detecting the temperature information of each nozzle by providing a temperature detection element which is formed for each print element by using a thin-film resistive element through an insulating film in a print element substrate.

Japanese Patent Laid-Open Nos. 2007-331193 and 2008-000914 each have proposed an inspection method of detecting the presence of a change in temperature drop (to be referred to as a feature point hereinafter) in the temperature drop process represented by a temperature curve and determining normal discharge if a feature point appears. It is thought that this feature point appears when the trailing end of a discharged droplet comes into contact with a print element to lower the temperature of the print element.

According to Japanese Patent Laid-Open Nos. 2007-331193 and 2008-000914, to facilitate detection of a feature point as a slight change, second order differential computation is performed to enhance the change to detect a feature point, thereby determining, based on the result, whether the discharge operation is normal discharge. At this time, however, noise is also simultaneously enhanced. This will lead to a determination error unless a noise component is made sufficiently smaller than a waveform change as a feature point. Although it is possible to obtain a feature point based on a curvature change of acquired temperature information. In this case, like the above case, a determination error occurs unless noise is made sufficiently smaller than a curvature change.

SUMMARY OF THE INVENTION

The present invention enables realization of a technique of improving the accuracy of determination whether discharge operation is normal discharge, by improving resistance to noise and detecting a feature point.

One aspect of the present invention provides a printing apparatus comprising: a printhead that is provided with temperature detection elements respectively corresponding to heat generation elements which generate thermal energy for discharging ink from orifices, with a feature point appearing on a temperature profile detected by the temperature detection element when ink is normally discharged from the orifice; an application unit configured to apply a driving voltage to the heat generation element; and a control unit configured to control the application unit so as to apply a first driving voltage to the heat generation element to discharge ink from the orifice and then apply a second driving voltage to the heat generation element, before a timing when the feature point appears, so as not to cause bubbling or discharging of ink.

Further features of the present invention will be apparent from the following description of exemplary embodiments with reference to the attached drawings.

DESCRIPTION OF THE EMBODIMENTS

Embodiments of the present invention will now be described in detail with reference to the drawings. It should be noted that the relative arrangement of the components, the numerical expressions and numerical values set forth in these embodiments do not limit the scope of the present invention unless it is specifically stated otherwise.

A printing apparatus using an ink-jet printing system will be described below. The printing apparatus may be a single-function printer having only a printing function or a multi-function printer having a plurality of functions, for example, a printing function, FAX function, and scanner function. Alternatively, for example, the printing apparatus may be a manufacturing apparatus for manufacturing, for example, a color filter, electronic device, optical device, or microstructure, by a predetermined printing system.

In the following specification, "print" is not only to form significant information such as characters and graphics but also to form, for example, images, figures, patterns, structures on printing media in a broad sense, regardless of whether the information formed is significant or insignificant or whether the information formed is visualized so that a human can visually perceive it, or to process printing media.

"Printing media" are any media capable of receiving ink, such as cloth, plastic films, metal plates, glass, ceramics, wood, and leather, as well as paper sheets used in general printing apparatuses.

In addition, "ink" should be broadly interpreted like the definition of "print" described above. That is, ink is a liquid which is applied onto a printing medium to be used to form images, figures, and patterns, and to process the printing medium, or to process ink (for example, to solidify or insolubilize a colorant in ink applied to a printing medium).

Furthermore, "print element" (to be also referred to as "nozzle" sometimes) generically means an ink orifice, a liquid channel communicating with the orifice, and en element which generates energy used to discharge ink unless otherwise specified.

Figure 1:
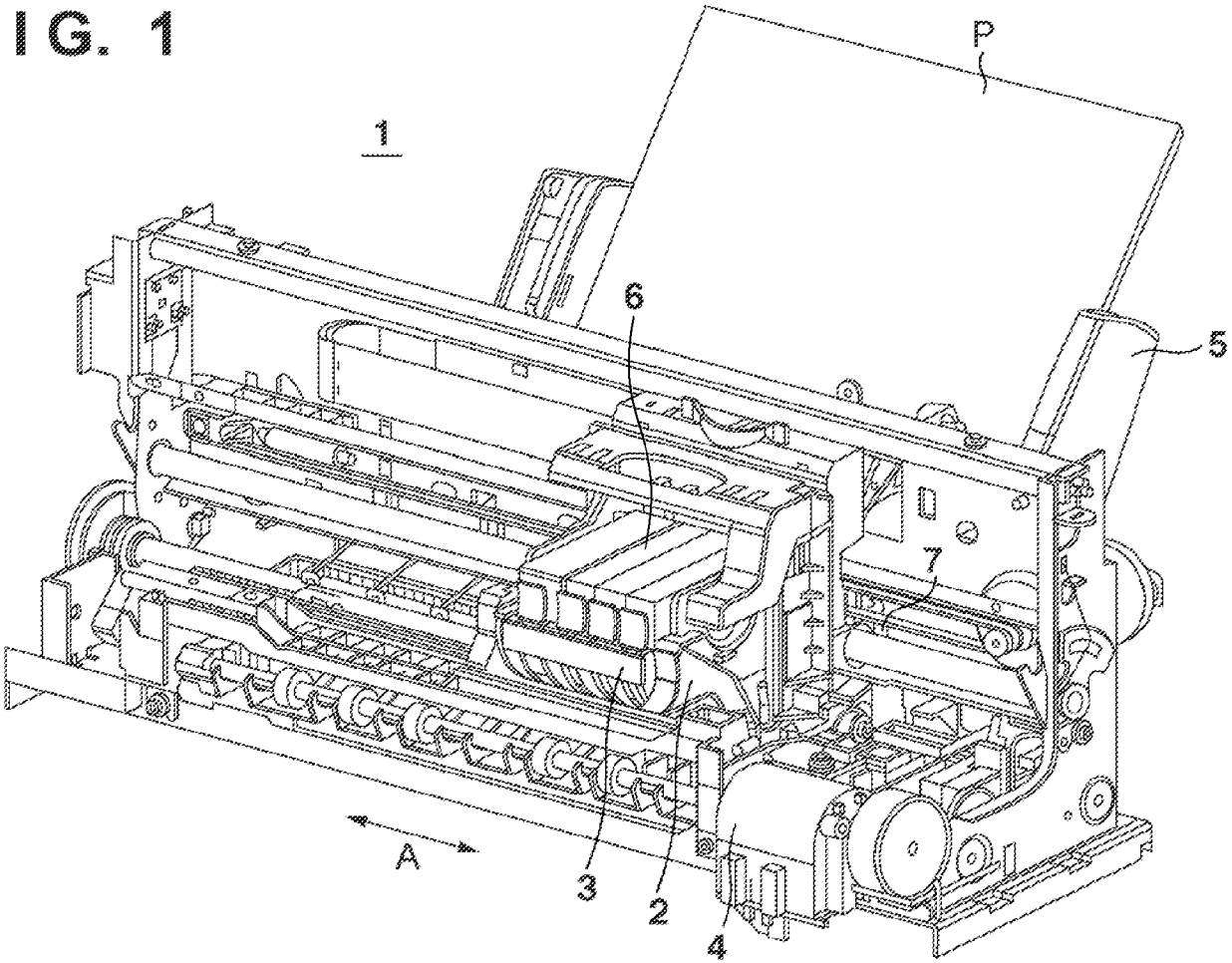
FIG. 1 is a perspective view of an ink-jet printing apparatus (to be referred to as a printing apparatus hereinafter) 1 according to an embodiment of the present invention.

FIG. 1 is a perspective view of an ink-jet printing apparatus (to be referred to as a printing apparatus hereinafter) 1 according to an embodiment of the present invention.

The printing apparatus 1 includes an ink-jet printhead (to be referred to as a printhead hereinafter) 3 which discharges ink according to an ink-jet scheme and is mounted on a carriage 2, and prints by reciprocating the carriage 2 in the arrow A direction (scanning direction). The printing apparatus 1 feeds a printing medium P such as a printing sheet through a paper feed mechanism 5, and conveys the sheet to a printing position. The apparatus prints by discharging ink onto the printing medium P at the printing position from the printhead 3.

In addition to the printhead 3, for example, an ink cartridge 6 is mounted on the carriage 2 of the printing apparatus 1. The ink cartridge 6 stores ink to be supplied to the printhead 3. Note that the ink cartridge 6 is detachable with respect to the carriage 2.

The printing apparatus 1 shown in FIG. 1 can perform color printing. For this purpose, four ink cartridges respectively storing, for example, magenta (M), cyan (C), yellow (Y), and black (K) inks are mounted on the carriage 2. These four ink cartridges can be independently attached and detached.

The printhead 3 is provided with a print element substrate (to be sometimes briefly referred to as a substrate hereinafter), on which a plurality of nozzle arrays are arranged. The printhead 3 is based on the ink-jet printing system of discharging ink by using thermal energy. For this reason, the printhead 3 is provided with print elements constituted by heat generation elements (to be referred to as heaters hereinafter) and the like and a control circuit for driving/controlling the heaters. The heaters are provided in correspondence with the respective nozzles (orifices). Pulse voltages are applied to the heaters in accordance with print signals.

A recovery apparatus 4 which recovers a discharge failure in the printhead 3 is disposed outside the reciprocation range (printing area) of the carriage 2. The position where the recovery apparatus 4 is provided is called a so-called home position or the like. While no printing operation is performed, the printhead 3 stands still at this position.

Figure 2A:
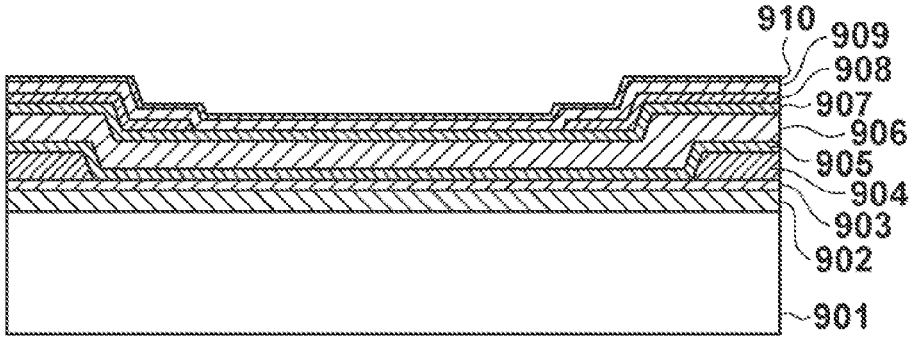
FIGS. 2A and 2B are views showing an example of the arrangement of print element substrate.
Figure 2B:
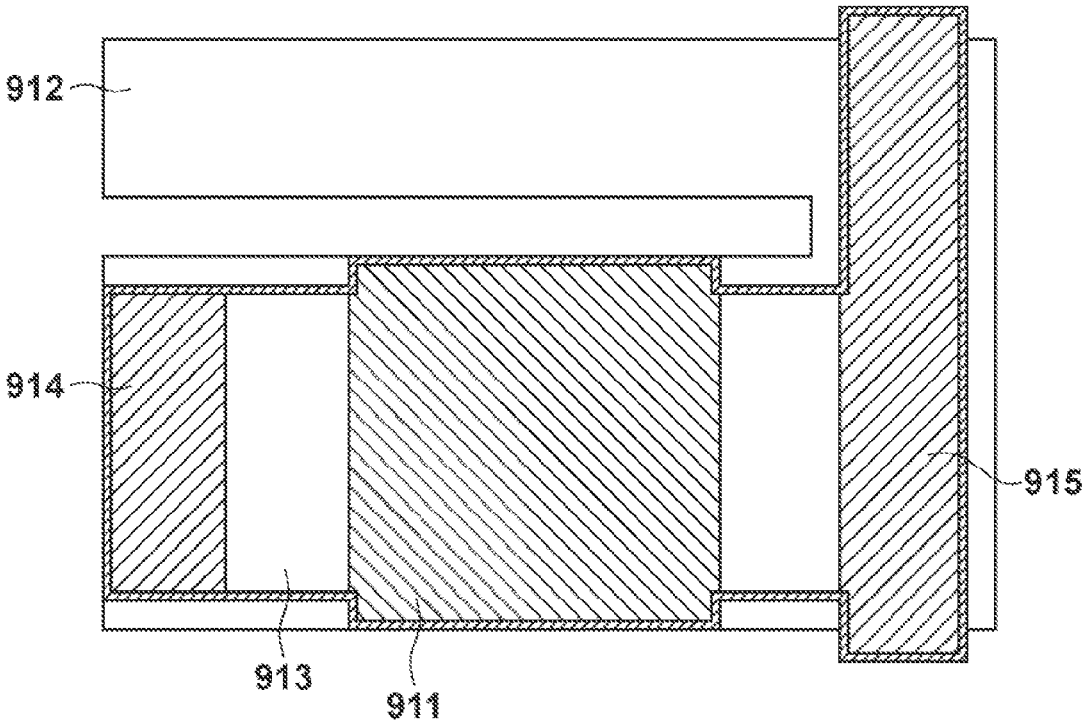

The schematic arrangement of the above print element substrate will be described with reference to FIGS. 2A and 2B. FIG. 2A shows an example of the sectional arrangement of the print element substrate. FIG. 2B shows an example of the planar arrangement of the print element substrate. For the sake of descriptive convenience, an illustration of nozzles will be omitted.

As shown in FIG. 2A, a plurality of layers are formed on a silicon substrate 901 of the print element substrate. More specifically, an insulating film PSG 903 is formed on the silicon substrate 901 through a field oxide film 902 made of $SiO_2$ or the like. A temperature detection element 905 formed from a thin-film resistive element made of Al, Pt, Ti, Ta, or the like is provided on the insulating film PSG 903, together with an AL1 intersection 904 which connects/wires each temperature detection element 905.

An interlayer insulation film 906 made of SiO or the like is further provided on the upper layer. A heater 907 and an AL2 interconnection 908 are provided on the interlayer insulation film 906. The heater 907 is made of TaSiN or the like and performs electrothermal conversion. The AL2 interconnection 908 connects the heater 907 to a driving circuit formed from a silicon substrate. Other films formed on the interlayer insulation film 906 include a passivation film 909 made of $SiO_2$ or the like and an anti-cavitation film 910 made of Ta or the like which improves the anti-cavitation property on the heater 907.

As shown in FIG. 2B, there are, on the flat surface of the print element substrate, a heater area 911, an area indicating an AL2 interconnection 912 which is connected to a driving circuit, an area indicating an AL1 interconnection 914 as an individual interconnection for a temperature detection element, and an area indicating an AL1 interconnection 915 as a common interconnection. In addition, the area enclosed by the thick line is an area 913 of the temperature detection element 905.

The arrangement of such a print element substrate is formed by a semiconductor process. The print element substrate according to this embodiment can be manufactured by placing the temperature detection element 905 on the AL1 layer and forming and patterning films, and hence can be manufactured without changing the structure of a conventional print element substrate.

Although FIG. 2B shows the temperature detection element 905 in a rectangular shape, the present invention is not limited to this. For example, the temperature detection element 905 may have a meandering shape. The larger the resistance of the temperature detection element 905, the larger a detection signal. For this reason, this shape allows to detect a temperature change with high accuracy.

Figure 3:
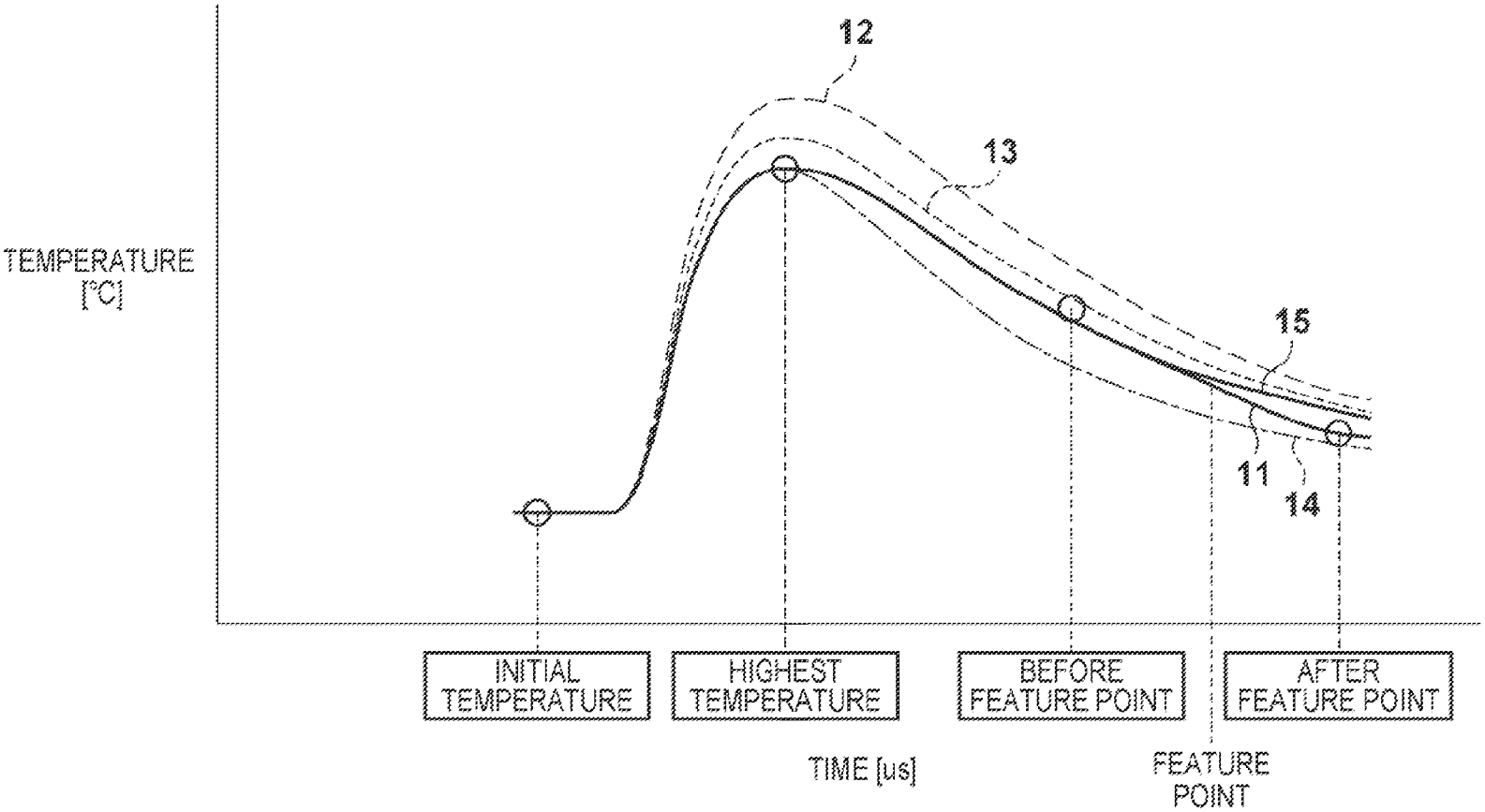
FIG. 3 is a graph showing examples of the temperature profiles of a temperature detection element when a driving voltage is applied to a heater.

The temperature profile of a temperature detection element when a driving voltage for ink discharge is applied to the heater will be described next with reference to FIG. 3.

Reference numerals 11 to 15 denote temperature profiles corresponding to various discharge states. More specifically, reference numeral 11 denotes a temperature profile at the time of normal discharge; 12, a temperature profile at the time of discharge abnormality caused by the retention of bubbles in the nozzle; 13, a temperature profile at the time of discharge abnormality caused because the deposition of an impurity on the channel has made it impossible to perform normal ink refilling operation; 14, a temperature profile at the time of discharge abnormality caused by ink adhering to the nozzle surface; and 15, a temperature profile at the time of discharge abnormality caused by clogging of the orifice with a foreign substance.

On the temperature profile 11 at the time of normal discharge, a feature point appears at a point where the speed of temperature drop changes after the lapse of a predetermined time since the time at which a detection temperature reaches the highest temperature. With the nozzle shape used in this embodiment, the feature point appears about 7 μs after the application of a driving voltage (first driving voltage) for ink discharge. Note that the time when this feature point appears varies depending on the structure of the head including an orifice and an ink channel or conditions for heat generation by a heater. It can be therefore properly set the timing of determination whether a feature point has appeared, depending on a printhead.

On the other hand, the temperature profiles 12 to 15, each obtained at the time of discharge abnormality, exhibit different characteristics relative to the temperature profile at the time of normal discharge. A common phenomenon, in particular, is that no feature point appears. It is therefore possible to determine whether normal discharge has been performed, by performing arithmetic processing for the waveform of a signal representing temperatures (to be referred to as a temperature waveform hereinafter) obtained in a predetermined time range, for example, the interval between a time before a feature point and a time after the feature point.

First Embodiment

The first embodiment will be described below. The first embodiment will exemplify a case in which after a first driving voltage is applied, a short pulse is applied as a second driving voltage in the interval between the application timing of the first driving voltage and the timing of the appearance of a feature point. Note that the first driving voltage is applied to discharge ink from an orifice, and is set to a corresponding voltage value and pulse width. The second driving voltage is set to a voltage value and pulse width small enough not to cause bubbling or discharging of ink. A control circuit (613 of FIG. 9) which will be described later sets the voltage value and pulse width corresponding to the first driving voltage pulse, and the voltage value and pulse width corresponding to the second driving voltage pulse.

Figure 4:
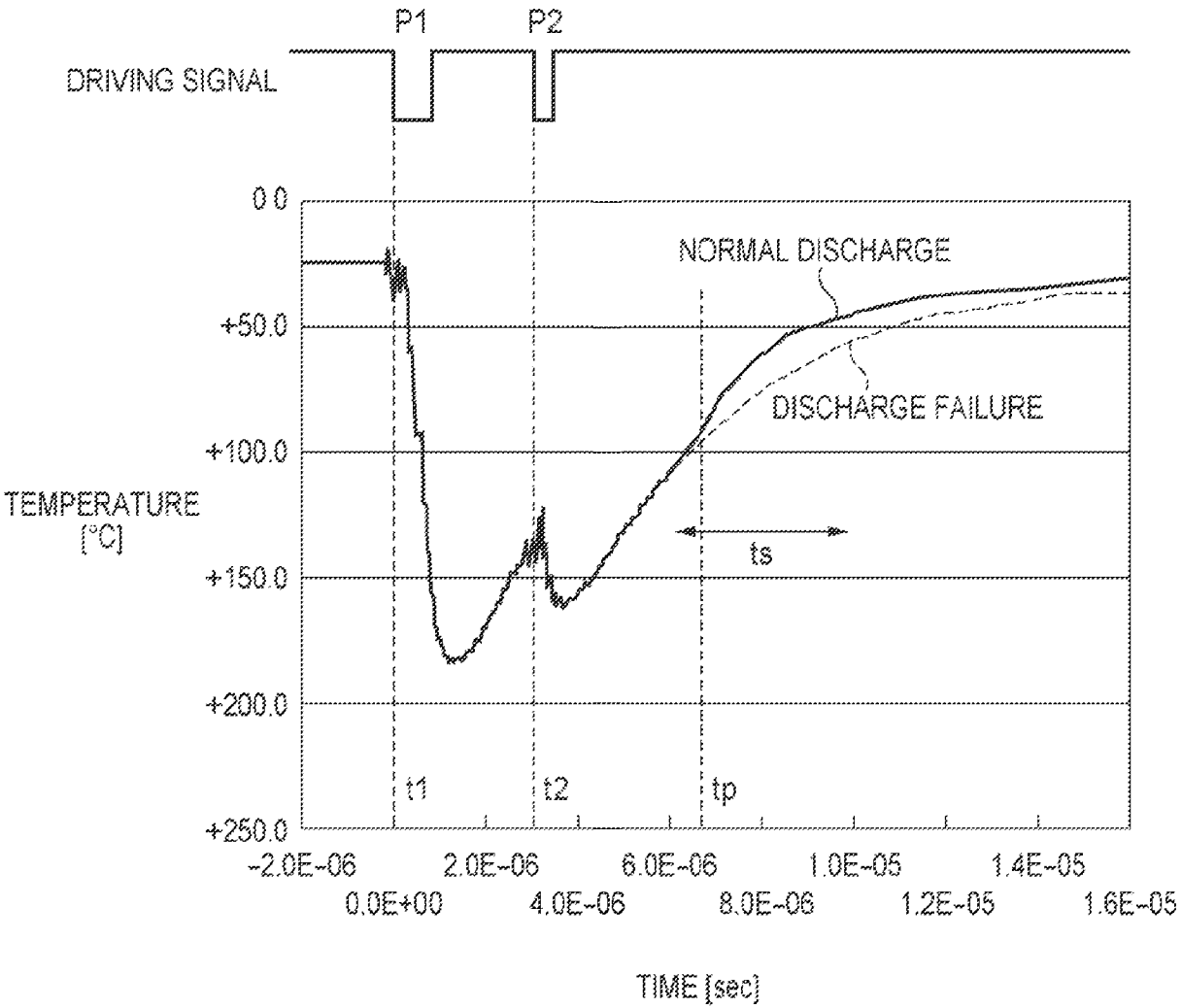
FIG. 4 is a graph showing the relationship between the input timing of a driving signal (driving voltage) to the heater and the temperature waveform of the temperature detection element.

A method of detecting a feature point according to this embodiment will be described first. FIG. 4 is a graph showing the relationship between the input timing of a driving signal (driving voltage) to a heater and the temperature waveform obtained by a temperature detection element. Note that "driving signal" is a signal for controlling the driving of a heater (print element) and generated based on a heat signal HE, a sub-pulse signal SP, and an application enable signal, details of which will be described later.

Assume that a first driving voltage P1 used for ink discharge has a pulse width of 0.75 μs. Assume that time tp when a feature point appears is a time about 7 μs after the application of P1 in a nozzle used in this embodiment. A second driving voltage P2 is applied at a timing between time t1 when the first driving voltage P1 is applied and time tp, that is, time t2 (=3 μs). Note that the second driving voltage P2 is applied with a pulse width (0.2 μs) short enough not to cause bubbling.

In this case, the temperature waveform detected by the temperature detection element indicates that the temperature rises as the first driving voltage P1 is applied, and changes to drop through the maximum attained temperature. As the second driving voltage P2 is applied at time t2 in the process of temperature drop, the temperature waveform indicates that the temperature rises again and then drops. At time tp, a feature point appears at the time of normal discharge, but does not appear at the time of discharge abnormality.

Figure 5:
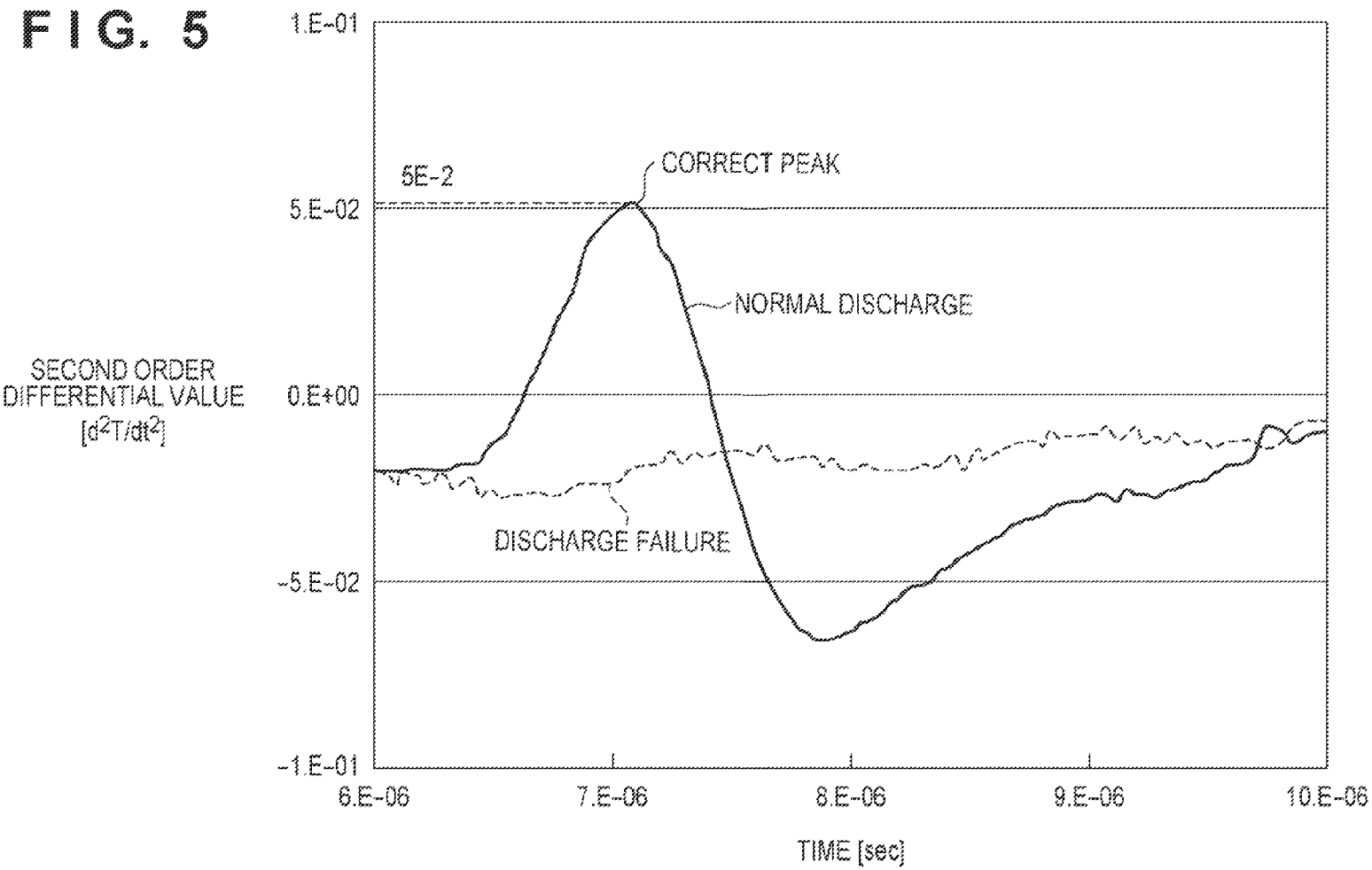
FIG. 5 is a graph showing an example of the waveform obtained by second order differential of a temperature waveform.

FIG. 5 shows the waveform obtained by performing second order differential of the temperature waveform in FIG. 4 in an interval is (time 6 μs to time 10 μs) near the feature point of the temperature waveform (a predetermined interval before and after the timing when the feature point is detected). As a result of the second order differential, a correct peak appears at the time of normal discharge but does not appear at the time of abnormal discharge (discharge failure). In this case, the value of the correct peak is about 5 E−2[$d^2T/dt^2$].

Figure 6:
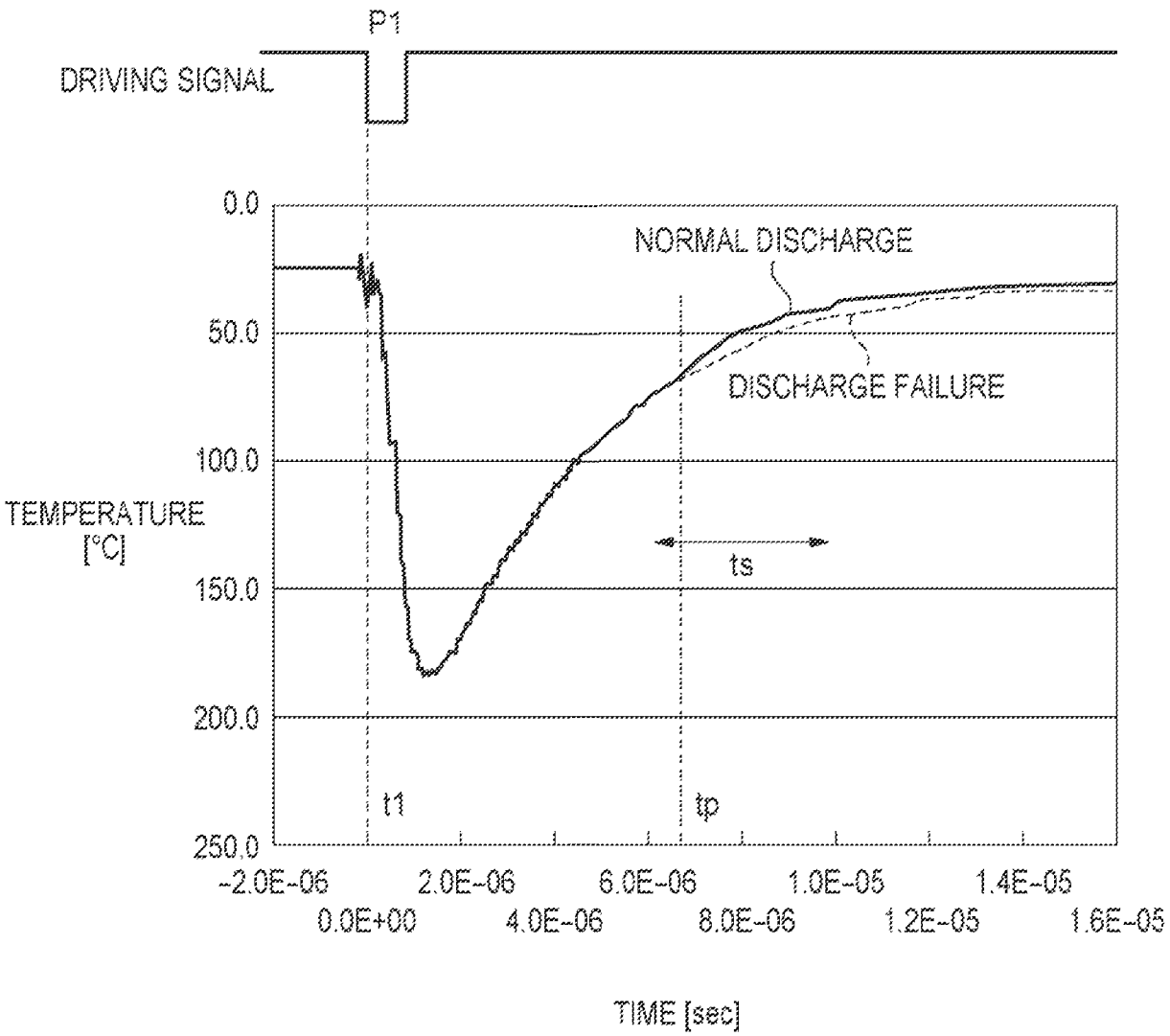
FIG. 6 is a graph for explaining a conventional technique.

A conventional method of detecting a feature point will be described as a comparative example relative to the arrangement of this embodiment. FIG. 6 is a graph showing the relationship between the input timing of a driving signal (driving voltage) to a heater and the temperature waveform obtained by a temperature detection element according to the related art. As in the above case, assume that a driving voltage applied for ink discharge has a pulse width of 0.75 μs. Assume also that time tp when a feature point appears is a time about 7 μs after the application of P1.

Figure 7:
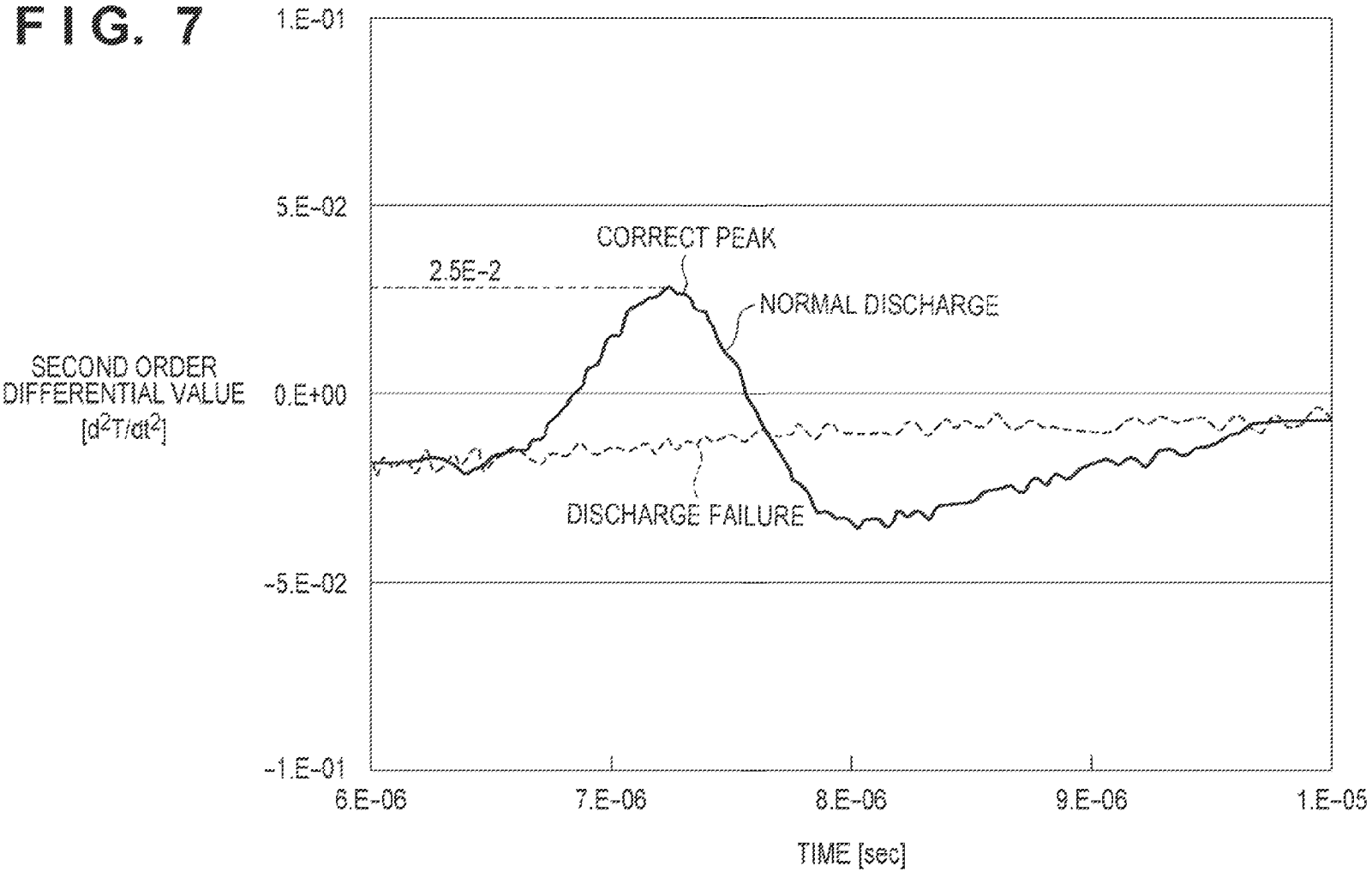
FIG. 7 is a graph for explaining the conventional technique.

FIG. 7 shows a waveform obtained by performing second order differential of the temperature waveform in an interval is (time 6 μs to time 10 μs) near the feature point shown in FIG. 6 (a predetermined interval before and after the timing when the feature point is detected). As a result of the second order differential, the value of a correct peak at the time of normal discharge is about 2.5 E−2[$d^2T/dt^2$].

Figure 8:
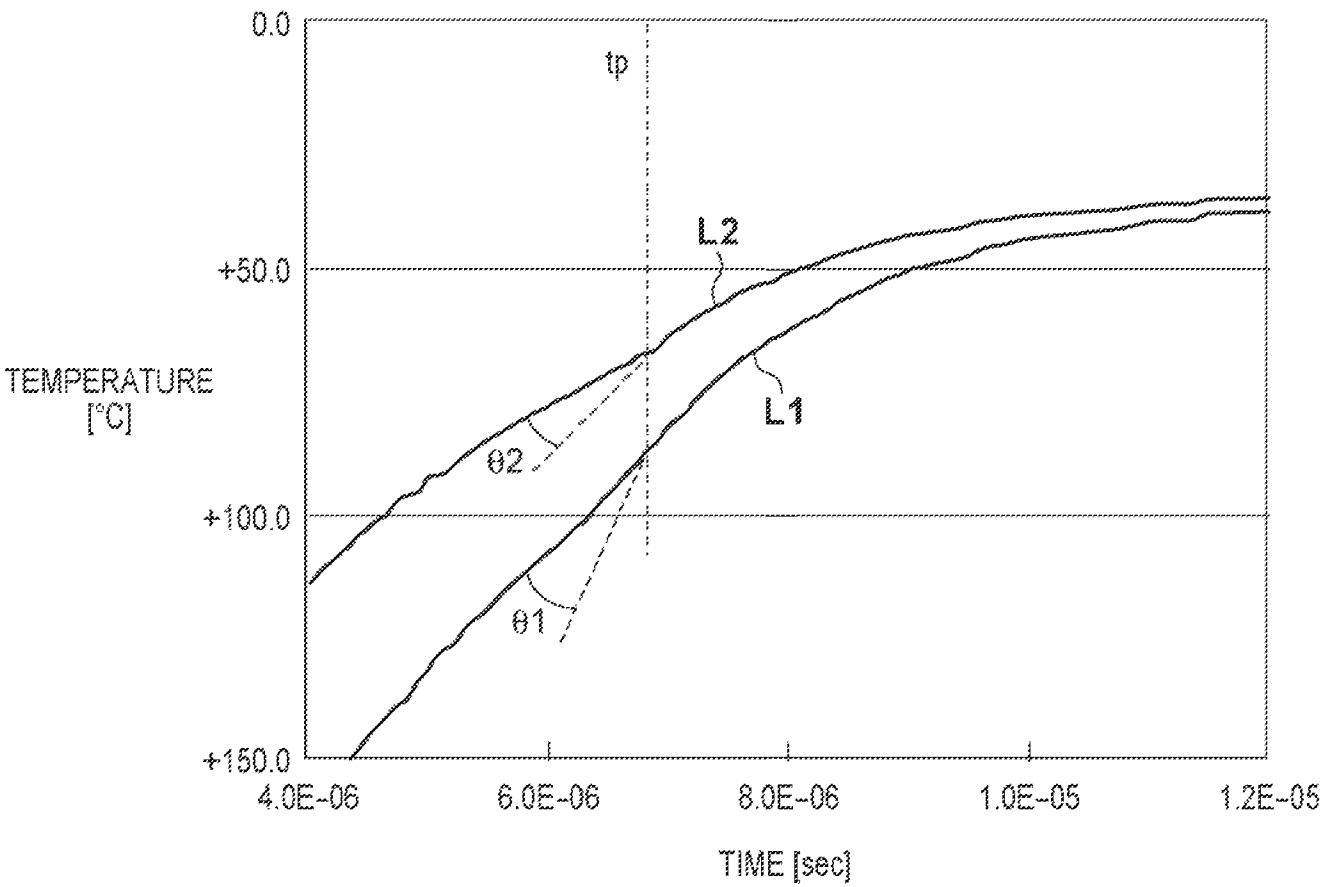
FIG. 8 is a graph showing examples of temperature waveforms near feature points in this embodiment and the conventional technique.

FIG. 8 shows temperature waveforms near feature points in this embodiment and the related art. A temperature waveform L1 indicates a temperature waveform near the feature point in the embodiment. A temperature waveform L2 indicates a temperature waveform near the feature point in the related art.

Consider the angles between the first half waveforms of the temperature waveform L1 according to this embodiment and of the temperature waveform L2 according to the related art, with feature point time tp being a boundary, and extended auxiliary lines (dotted lines) with almost curvatures conforming to the changes of the second half waveforms. In this case, an angle θ1 indicating the degree of waveform change corresponds to L1 according to the embodiment, and θ2 indicating the degree of waveform change corresponds to L2 according to the related art.

The magnitudes of these angles are reflected in the magnitudes of correct peak values of second order differential waveforms. When these angles are compared with each other, θ1 is slightly larger than θ2. The difference between the angles appears as the difference between the correct peak values. Since the magnitude of the curvature of a waveform is proportional to the magnitude of temperature change. It is thought that the cooling temperature difference in the method according to this embodiment is larger than that in the related art. This is because the application of the second driving voltage P2 heats the heater again and rises the temperature.

In the interval ts (see FIG. 4) near the feature point of the temperature waveform described above, a natural temperature drop state can be set, which exhibits a smooth waveform transition. In addition, the end timing of the application of the second driving voltage can come before the start time of ts including a delay time of heat conduction.

Figure 9:
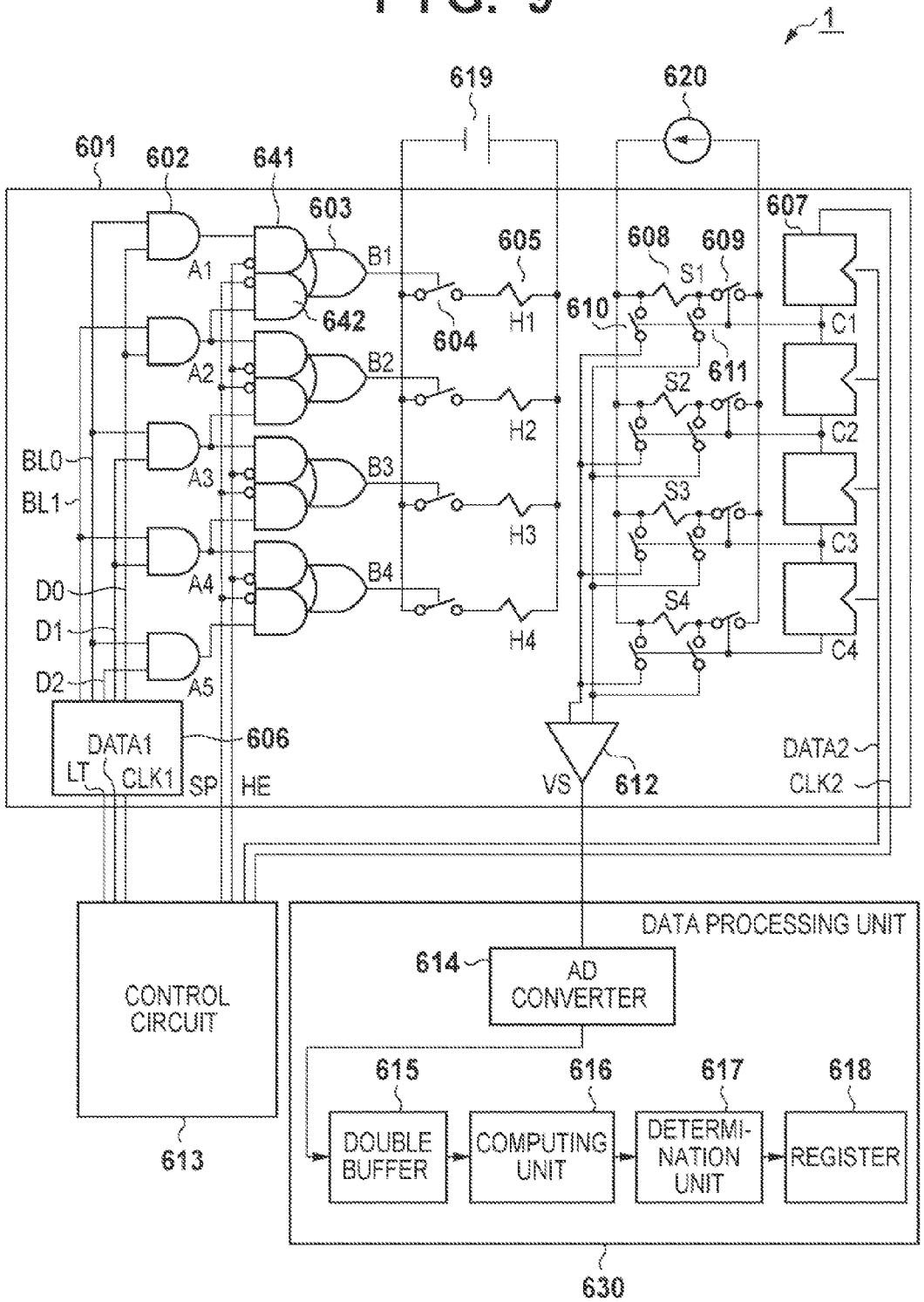
FIG. 9 is a view showing an example of the functional arrangement of the printing apparatus 1 shown in FIG. 1.

An example of the functional arrangement of a printing apparatus 1 shown in FIG. 1 will be described next with reference to FIG. 9. An arrangement associated with determination whether discharge operation is normal discharge will be mainly described below.

The arrangement of the printing apparatus 1 is largely divided into a print element substrate 601 located on the printhead side, and a control circuit 613 and a data processing unit 630 which are located on the main body side.

The control circuit 613 controls the operation of each component of the printing apparatus 1. The control circuit 613 controls, for example, a driving circuit for heaters (H1 to H4) 605 and temperature detecting operation via the driving circuit.

The data processing unit 630 includes an AD converter 614, a double buffer 615, a computing unit 616, a determination unit 617, and a register 618. In the data processing unit 630, the respective components perform various kinds of data processing based on a temperature detection signal VS.

More specifically, the AD converter 614 converts the temperature detection signal VS from analog data into digital data. The double buffer 615 is constituted by two registers, and temporarily stores digital data from the AD converter 614 while alternately switching the two registers for each time-divisional driving time. The computing unit 616 performs second order differential with a digital filter. The determination unit 617 determines, based on the computation result obtained by the computing unit 616, whether discharge operation is normal discharge. The register 618 stores a determination result on each nozzle.

In this case, the arrangement of the print element substrate 601 is largely divided into a driving circuit for driving the heaters and a temperature detection circuit for detecting the temperatures of the heaters.

The driving circuit will be described first. The driving circuit includes a circuit block 606, AND gates 602, first driving voltage applying circuits 641, second driving voltage applying circuits 642, selectors 603, driving switches 604, the heaters 605, and a power supply 619 for driving the heaters.

The circuit block 606 includes a 2-line decoder, a 3-bit shift register, and a latch. The circuit block 606 receives various kinds of signals (CLK1 (serial clock), DATA1 (serial data including print data and time-divisional driving data), LT (latch signal)) from the control circuit 613. With this operation, the circuit block 606 generates time-divisional driving signals (block selection signals) BL0 and BL1 and print signals D0 to D2 and outputs them to the AND gates 602.

The AND gates 602 generates an application enable signal A by calculating the logical product between a time-divisional driving signal BL and a print signal D.

The first driving voltage applying circuit 641 and the second driving voltage applying circuit 642 are provided for each heater, and output driving signals (the first and second driving voltages) to the corresponding heater. The first driving voltage applying circuit 641 outputs a first driving voltage for applying the first driving voltage P1 by calculating the logical product between the application enable signal A and the heat signal HE. The second driving voltage applying circuit 642 outputs a second driving voltage for applying the second driving voltage P2 by calculating the logical product between the application enable signal A and the sub-pulse signal SP.

The selector 603 selects the first driving voltage applying circuit 641 or the second driving voltage applying circuit 642, and outputs the first or second driving voltage from the selected circuit to the driving switch 604. The driving switch 604 is a MOS transistor which turns on/off the heater 605. With this arrangement, the driving circuit time-divisionally drives a plurality of heaters provided for this apparatus.

The temperature detection circuit will be described next. The temperature detection circuit includes shift registers 607, temperature detection elements 608, selection switches 609, readout switches 610 and 611, a differential amplifier 612, and a constant current source 620 for biasing the temperature detection elements. The temperature detection elements 608 are provided in correspondence with the heaters 605. Note that the temperature detection elements 608 are arranged near the corresponding heaters 605.

The selection switches 609 are MOS transistors for selecting the temperature detection elements 608. The readout switches 610 and 611 are MOS transistors for reading out terminal voltages from the temperature detection elements 608. The shift registers 607 receive shift clocks CLK2 and shift data DATA2, and sequentially output selection signals C (C1 to C4). The differential amplifier 612 receives terminal voltages from the temperature detection elements 608 and generates differential amplification signals (that is, temperature detection signals VS).

Figure 10:
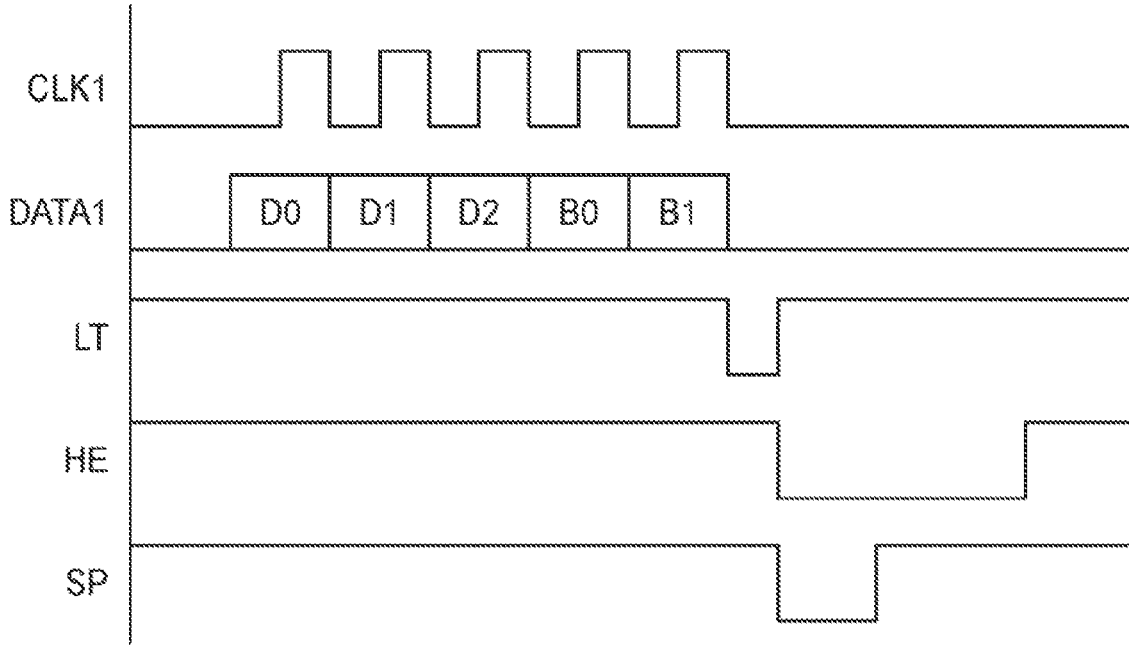
FIG. 10 is a timing chart showing an example of the output timings of various kinds of signals from a control circuit 613 shown in FIG. 9.

The output timings of various kinds of signals (CLK1, DATA1, LT, HE, and SP) from the control circuit 613 shown in FIG. 9 will be described below with reference to FIG. 10.

The control circuit 613 transfers the serial data DATA1 including print data and time-divisional driving data in synchronism with the serial clock CLK1. The printhead (print element substrate) holds the input signal in a latch in accordance with the timing of a latch signal (LT signal). In addition, immediately after this operation, the control circuit 613 transfers the heat signal HE corresponding to an application pulse of the first driving voltage and the sub-pulse signal SP corresponding to an application pulse of the second driving voltage to the printhead side.

The print element substrate sequentially selects the heaters based on signals from the control circuit 613 and sequentially selects the temperature detection elements in synchronism with the selection. Selecting operation for the heaters and the temperature detection elements will be described below with reference to FIG. 11. Assume that a time-divisional driving time tb is, for example, 4 μs shorter than the interval is (time 6 μs to 10 μs) in which a feature point can appear. The following is a case in which the apparatus controls ink discharge from each orifice by time-divisional driving in a cycle shorter than the interval from the timing of the application of the first driving voltage to the timing when a feature point is detected.

In this case, in an interval tb1, the selector 603 corresponding to the heater H1 selects the first driving voltage applying circuit 641. At this time, the corresponding AND gate 602 receives the heat signal HE and the application enable signal A1, and applies an application pulse of the first driving voltage to the heater H1.

In an interval tb2 (following the interval tb1), the selector 603 corresponding to the heater H1 selects the second driving voltage applying circuit 642, and the selector 603 corresponding to the heater H2 selects the first driving voltage applying circuit 641. At this time, the corresponding AND gate 602 receives the heat signal HE, the sub-pulse signal SP, and an application enable signal A2. The AND gate 602 then applies an application pulse of the second driving voltage to the heater H1, and applies an application pulse of the first driving voltage to the heater H2.

With this operation, an application pulse indicated by a driving signal (driving voltage) B1 is input to the heater H1. That is, in the interval tb1, an application pulse of the first driving voltage is applied. In the interval tb2, an application pulse of the second driving voltage is applied. The same processing is sequentially performed for the heaters H2, H3, and H4.

When applying a voltage to a heater, the control circuit 613 outputs CLK2 and DATA2 to the shift register 607 corresponding to the heater H1 in synchronism with the selection of the heater H1 in the interval tb1 to select a corresponding temperature detection element. In the interval tb2, the shift register 607 outputs the selection signal C1 to select a temperature detection element S1. With this operation, the data processing unit 630 acquires the temperature detection signal Vs corresponding to the heater H1 via the differential amplifier 612. Subsequently, in the same manner, the apparatus sequentially performs the same processing as that described above for temperature detection elements S2, S3, and S4.

In this case, the feature point timing at S1 has appeared in the interval tb2 (te). In the data processing unit 630, the AD converter 614 acquires digital data by AD conversion of the temperature detection signal VS in the interval te, and the double buffer 615 stores the digital data in one register.

Noise due to operation such as driving of a logic gate or heater or noise on an external transmission path is superimposed on this digitalized temperature information stored in the double buffer 615. The computing unit 616 in the data processing unit 630 performs digital filter processing for the reduction of noise that degrades the temperature detection accuracy and performs second order differential by using the temperature information from which noise has been reduced. The determination unit 617 detects the presence/absence of a correct peak in this second order differential waveform, and determines, based on the detection result, whether the discharge operation is normal discharge. Thereafter, the data processing unit 630 holds the result in the register 618.

The printing apparatus 1 sequentially selects heaters and temperature detection elements corresponding to the heaters one by one in this manner, detects temperatures corresponding to all the heaters, and performs inspection (discharge inspection) to determine whether the state of discharge from each orifice is normal.

As has been described above, according to this embodiment, after the first driving voltage is applied to a print element, the second driving voltage is applied to the print element at a timing before a feature point appears on the temperature waveform in a temperature drop process which is detected from the print element.

For this reason, since the trailing end of a droplet comes into contact with a print element whose temperature is suppressed low, the cooling temperature of the print element increases, resulting in a larger change in temperature drop. This makes it easy to detect a feature point on the above temperature waveform and improve resistance to noise. It is therefore possible to improve the accuracy of determination whether discharge operation is normal discharge.

The above embodiment is an example of a typical embodiment of the present invention. However, the present invention is not limited to the embodiment described above with reference to the accompanying drawings and can be modified as needed within the range in which the gist of the present invention is not changed.

For example, the application of the second driving voltage need not be performed in the form of a short pulse as long as it can generate heat so as not to cause bubbling or discharging of ink. For example, the above application may be performed in the form of a long pulse with a low voltage or may be performed in another shape of pulse waveform.

Figure 11:
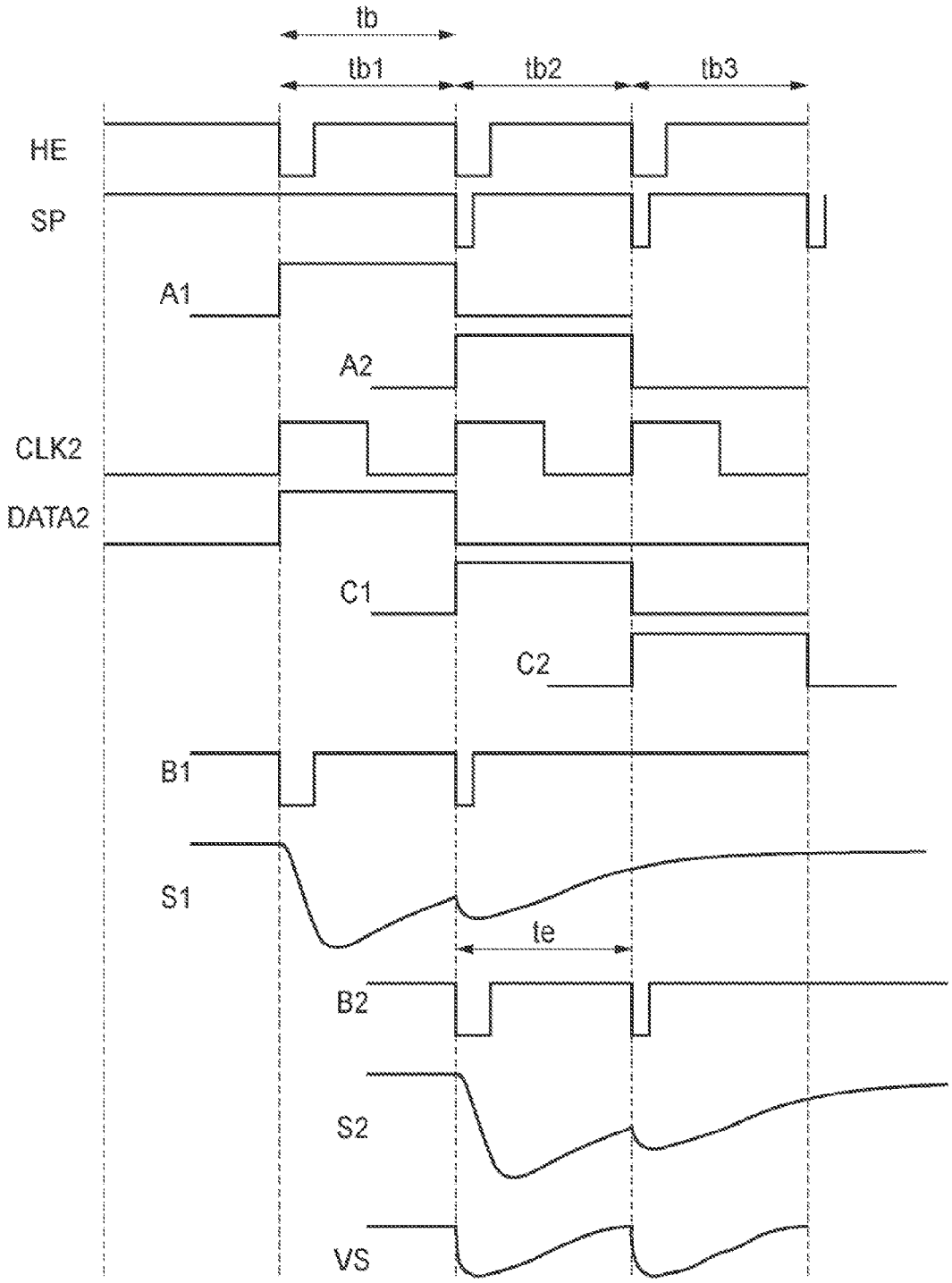
FIG. 11 is a timing chart for explaining an example of the selecting operation of a heater and temperature detection element.

In addition, the description with reference to FIG. 11 has exemplified the case in which the time-divisional driving time tb is 4 μs, that is, the interval is (time 6 μs to time 10 μs) in which a feature point can appear. However, the present invention is not limited to this. For example, the first and second driving voltages may be applied within one time-divisional driving time, and the time-divisional driving time tb may be set to a period longer than the time when feature point time tp comes after the application of the first driving voltage. This eliminates the necessity to use the selectors 603, and hence can simplify the circuit arrangement of the print element substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-126700 filed on Jun. 6, 2011, which is hereby incorporated by reference herein in its entirety.

What is claimed is:

1. A printing apparatus comprising:

a printhead, the printhead including a plurality of heat generation elements which generate thermal energy for discharging ink from orifices, and a plurality of temperature detection elements corresponding to the plurality of heat generation elements;

an application unit configured to apply a driving voltage to the plurality of heat generation elements;

a control unit configured to control said application unit so as to apply a first driving voltage to the plurality of heat generation elements to discharge ink from the orifices and then apply a second driving voltage to the plurality of heat generation elements, so as not to discharge ink in a temperature dropping process, at a timing before a feature point appears on a temperature profile based on a detection result of the plurality of temperature detection elements; and a determination unit configured to determine whether ink is normally discharged from the orifices based on the temperature profile.

2. The apparatus according to claim 1, wherein said determination unit determines, upon detection of a feature point on a temperature profile, that a discharged state of ink from the corresponding orifice is normal, and determines, upon no detection of the feature point on the temperature profile, that a discharged state of ink is abnormal.

3. The apparatus according to claim 2, wherein said determination unit performs the determination by performing second order differential of a signal, of the temperature profile, representing a temperature in a predetermined interval before and after detection of the feature point in a waveform of a signal representing the temperature.

4. The apparatus according to claim 2, wherein said control unit controls discharging of ink from each orifice by time-divisional driving in a cycle shorter than an interval from application of the first driving voltage to detection of the feature point so as to apply the first driving voltage to a corresponding heat generation element in accordance with each time-divisional driving operation and apply the second driving voltage to the heat generation element at a timing of time-divisional driving following the application of the first driving voltage.

5. The apparatus according to claim 2, wherein said control unit controls discharging of ink from each orifice by time-divisional driving in a cycle longer than an interval from application of the first driving voltage to detection of the feature point so as to apply the first driving voltage and the second driving voltage at one time-divisional driving timing.

6. A discharge detection method for a printhead including a plurality of heat generation elements which generate thermal energy for discharging ink from orifices and a plurality of temperature detection elements corresponding to the plurality of heat generation elements, the method comprising:

applying a first driving voltage to a heat generation element to discharge ink from an orifice;

detecting a temperature using a temperature detecting element corresponding to the heat generation element to result in a temperature profile;

applying a second driving voltage to the heat generation element, so as not to discharge ink in a temperature dropping process, at a timing before a feature point appears on the temperature profile based on the detection result of the temperature detection element and after the first driving voltage is applied; and determining whether ink is normally discharged from the orifices based on the temperature profile.

* * * * *